US006305198B1

(12) United States Patent
Chastain et al.

(10) Patent No.: US 6,305,198 B1
(45) Date of Patent: Oct. 23, 2001

(54) PADLOCK

(75) Inventors: David Paul Chastain, Acton; John Darrin Fiegener, Mendon; Roy Alden Thompson, Mattapan; Joseph Robert Geringer, Melrose; Harry West, Lexington; Ari Tao Adler, Cambridge; Maryann Finiw, Boston, all of MA (US); Pete Kajuch, Brookfield; Jesse Alan Marcelle, Franklin, both of WI (US)

(73) Assignee: Master Lock Company, Milwaukee, WI (US)

( * ) Notice: Subject to any disclaimer, the term of this patent is extended or adjusted under 35 U.S.C. 154(b) by 0 days.

(21) Appl. No.: 09/235,338

(22) Filed: Jan. 22, 1999

(51) Int. Cl.[7] ..... E05B 67/28
(52) U.S. Cl. ..... 70/40; 70/52; 70/56; 70/417
(58) Field of Search ..... 70/54–56, 40, 70/52, 417

(56) References Cited

U.S. PATENT DOCUMENTS

| | | |
|---|---|---|
| 8,318 | 8/1851 | Tilton . |
| 116,972 | 7/1871 | Madge . |
| 229,332 | 6/1880 | Pease . |
| 255,164 | 3/1882 | Grout . |
| 483,866 | 10/1892 | Price . |
| 536,196 | 3/1895 | Edgar . |
| 556,232 | 3/1896 | Werner . |
| 587,609 | 8/1897 | Roland . |
| 596,596 | 1/1898 | Johnson . |
| 767,004 | 8/1904 | Muchowicz . |
| 816,492 | 3/1906 | Mohr . |
| 821,657 | 5/1906 | Loftin . |
| 823,919 | 6/1906 | Caldwell . |
| 952,643 | 3/1910 | Roche . |
| 1,003,331 | 9/1911 | Caldwell . |

(List continued on next page.)

FOREIGN PATENT DOCUMENTS

| | | | | |
|---|---|---|---|---|
| 73849 | | 10/1944 | (CS) . | |
| 246104 | * | 5/1912 | (DE) | 70/40 |
| 346103 | * | 12/1921 | (DE) | 70/40 |
| 366427 | | 1/1923 | (DE) . | |
| 811927 | * | 8/1951 | (DE) | 70/52 |
| 1 780 397 | | 12/1971 | (DE) . | |
| 638078 | | 5/1928 | (FR) . | |
| 24706 | | 10/1910 | (GB) . | |
| 270983 | | 5/1927 | (GB) | 70/40 |
| 571487 | | 8/1945 | (GB) . | |
| 1602963 | | 10/1990 | (RU) . | |

*Primary Examiner*—Lloyd A. Gall
(74) *Attorney, Agent, or Firm*—Calfee, Halter & Griswold

(57) ABSTRACT

A padlock is provided with a multi-layer protective metal shell having non-aligned, alternating seams among the various layers, primary and secondary key-operable locks attached to the shackle of the padlock by a drive linkage that will fail before the primary and secondary locks to maintain the integrity of the lock, an ergonomic shape, an offset shackle for facilitating use of the lock in close-quarters applications, and a modular cushioned bumper for attachment to the outside of the lock body that is color-coded to correspond to a key and includes a protective cover over the keyway accessing the lock cylinder which is moveable to facilitate insertion of the key into the padlock.

6 Claims, 14 Drawing Sheets

U.S. PATENT DOCUMENTS

| | | | | |
|---|---|---|---|---|
| 1,062,594 | | 5/1913 | Isidor . | |
| 1,103,015 | | 7/1914 | Andrus . | |
| 1,153,405 | | 9/1915 | Rogers . | |
| 1,382,186 | * | 6/1921 | Godshalk | 70/52 |
| 1,490,453 | | 4/1924 | Caldwell . | |
| 1,581,953 | | 4/1926 | Jackson . | |
| 1,662,612 | | 3/1928 | Junkunc . | |
| 2,491,337 | | 12/1949 | Segal | 70/419 |
| 2,508,302 | | 5/1950 | Stue | 70/19 |
| 2,714,304 | | 8/1955 | Dedda | 70/406 |
| 2,874,563 | | 2/1959 | Schlage | 70/455 |
| 3,260,079 | | 7/1966 | Caskey | 70/25 |
| 3,267,707 | | 8/1966 | Adams | 70/419 |
| 3,848,440 | | 11/1974 | Manuel | 70/55 |
| 3,983,725 | | 10/1976 | Manuel et al. | 70/55 |
| 4,134,280 | | 1/1979 | Pelavin | 70/55 |
| 4,271,691 | | 6/1981 | Logan | 70/422 |
| 4,297,861 | | 11/1981 | Dykes | 70/55 |
| 4,317,344 | | 3/1982 | Barnard | 70/55 |
| 4,372,138 | * | 2/1983 | De Forrest | 70/56 |
| 4,464,915 | * | 8/1984 | Moshe et al. | 70/52 |
| 4,519,226 | | 5/1985 | Hadaway | 70/48 |
| 4,534,190 | | 8/1985 | Stanich | 70/54 |
| 4,567,740 | | 2/1986 | Kelly | 70/55 |
| 4,576,022 | | 3/1986 | Gamble | 70/55 |
| 4,651,543 | | 3/1987 | Heald et al. | 70/54 |
| 4,718,259 | * | 1/1988 | Appelbaum | 70/52 X |
| 4,790,163 | | 12/1988 | Appelbaum | 70/455 |
| 4,899,560 | * | 2/1990 | Chen | 70/52 |
| 4,905,486 | | 3/1990 | Appelbaum | 70/54 |
| 4,998,423 | | 3/1991 | Hsu | 70/40 |
| 5,009,087 | | 4/1991 | Long | 70/49 |
| 5,033,279 | | 7/1991 | Lebrecht | 70/55 |
| 5,044,180 | | 9/1991 | Lebrecht | 70/48 |
| 5,046,339 | | 9/1991 | Krell | 70/55 |
| 5,146,771 | | 9/1992 | Loughlin | 70/56 |
| 5,150,592 | | 9/1992 | Lin | 70/190 |
| 5,156,029 | | 10/1992 | Heald | 70/55 |
| 5,236,527 | | 8/1993 | Brodsky | 156/85 |
| 5,548,981 | | 8/1996 | Kirk | 70/58 |
| 5,611,225 | | 3/1997 | Resch et al. | 70/422 |
| 5,704,231 | | 1/1998 | Heald | 70/54 |
| 5,713,224 | | 2/1998 | Liou | 70/34 |
| 5,755,121 | | 5/1998 | Crass | 70/52 |
| 5,761,935 | | 6/1998 | Adelmeyer | 70/55 |
| 5,819,560 | | 10/1998 | Grahovec et al. | 70/38 A |
| 5,921,123 | * | 7/1999 | Schwarzkopf et al. | 70/40 X |
| 5,987,940 | * | 11/1999 | Chang | 70/52 X |

* cited by examiner

PADLOCK

BACKGROUND OF THE INVENTION

Padlocks typically have a single locking mechanism, but some have dual locking systems to further protect the lock against forced entry. For example, U.S. Pat. No. 5,044,180 to Lebrecht shows a round padlock with a round shackle. A plug and cylinder lock operates the shackle via a primary drive prong. A secondary lock latch also locks the shackle, and is disengageable therefrom by a cam which is rotatable by the key. U.S. Pat. No. 4,998,423 to Hsu shows a similar structure.

These locks, however, are still susceptible to attack especially from a prying force applied to the shackle. When a foreign object is inserted into the shackle and the shackle is forced open, shear stress is placed upon the primary drive prong, the secondary lock, and the cylinder. If the cylinder fails first, then the cylinder can be rotated, moving the primary drive prong, disengaging the secondary lock, and opening the lock.

Several patents show locks with breakable elements disposed between a key-operable lock and a bolt, for example U.S. Pat. Nos. 5,611,225 to Resch and 5,548,981 to Kirk, but a need exists for a padlock where the shear stress created by a foreign object being inserted into either the shackle or the cylinder will be carried by the primary drive prong, causing it to shear first, protecting the cylinder and preserving the integrity of the padlock.

Attempts at providing additional protection from attack led to the use of protective shells placed over the padlock. For example, U.S. Pat. No. 5,146,771 to Loughlin shows a padlock with a shield into which the padlock may be inserted to deter forced attack. U.S. Pat. No. 4,567,740 to Kelly also shows a padlock provided with a housing for receiving and shielding the padlock. These padlocks, however, do not obscure a significant portion of the shackle, especially where it enters the padlock. Further, these shells are still susceptible to being pried away from the lock or allowing a prying member to attack the padlock directly or would necessarily have a loose fit, enabling the shell to slide off of the lock.

Therefore, the need still exists for a protective shell that can be easily, form-fittingly attached to a padlock, can obscure a portion of the shackle, can completely cover the underlying padlock, and contains seams that are not aligned with the seams of the padlock to further deter prying open of the padlock body.

Protection of the key holes of locks from elements has been provided by different mechanisms. For example, U.S. Pat. No. 2,874,563 to Schlage shows a keyhole shutter arranged in a housing that is to be attached to a door lock. The shutter itself includes opposed shutter-members that are coplanar and of the general form of segments of circles, having their straight edges in engagement. The periphery of the members is formed with a circumferential recess in which resides a C-shaped spring. In order to facilitate entry of a key between the edges, the edges may be chamfered inwardly.

Similarly, U.S. Pat. No. 952,643 to Roche discloses a spring loaded keyhole cover for a trunk-lock having segmental gates located in back of a circular opening formed in and concentric with the boss-like outer casing or shell of the lock. The outer shell confines the gates in a shallow concentric chamber formed between its inner face and the outer face of a corresponding boss-like inner shell. German Patent No. DT 1,780,397 to Hulsbeck discloses a keyhole cover having two semicircular halves meeting at a beveled common edge and a circumferential spring clip, and French Patent No. 638,078 to Hamon shows a spring loaded key hole cover.

Other locks have employed sliding keyhole covers, These sliding keyhole covers are shown, for example, in the Roche patent which also discloses a vertical and a horizontal sliding-plate gate. U.S. Pat. No. 116,972 to Madge shows a plate that can be slid over the key hole of a padlock, and U.S. Pat. No. 8,318 to Tilton discloses a padlock with a slide plate that can entirely cover or uncover the keyhole. U.K. Pat. No. 571,487 to Smith discloses a key-hole cover slidably engaged on a mounting plate that is attached to a padlock. In U.S. Pat. No. 1,062,594 to Isidor, a suitcase lock is provided with a escutcheon having a slidably disposed closing member with a knob to convert the keyhole, while U.S. Pat. No. 2,491,337 to Segal discloses a slidable guided latching member that has a circular head for covering the keyhole of a cylinder lock. U.S. Pat. No. 3,267,707 to Adams show a slide member having a disk-like body and a forwardly projecting rectangular knob portion that is held against the lock body by a retainer cap. The retainer cap includes a circular aperture, a vertical excursion to receive the knob, and a slide channel to receive the disk portion of the slide member.

SUMMARY OF THE INVENTION

The padlocks of the present invention have a steel lock body constructed of at least two protective shell layers. The shell layers are constructed of a plurality of sub-shells which when joined together form seams. The seams are aligned so as to alternate from one shell layer to the next so that no single seam passes from the outside to the inside of the lock body. As the shell seams are not aligned, the security of the locks is increased.

An exterior cushioning bumper is provided to fit around the outside of the lock body. The bumper is part of a modular system whereby the color and style of the bumper can be selected and coded to match the color of the key for the padlock. The bumper keeps water out of the padlock, allows condensed water to drain from the padlock through weep holes, prevents abrasion with the locked object that would normally occur through contact with the hard surfaces of the padlock, provides comfort in the hand of the user, and covers the seams and rivet holes in the padlock shell. The bumper includes a movable cover for the keyway in the lock body.

In some embodiments, the movable cover is a slideable cover that can include a first section of suitable dimensions to cover the keyway and a raised portion extending from the first portion for engaging the finger of a user. This cover is slideably disposed in the bumper between a first position covering the passage and a second position exposing the keyway.

In other embodiment, the cover is a spring loaded shutter mechanism that opens automatically upon insertion of the key. The cover has two semi-circular halves and a spring clip disposed in a slot that extends around the circumference of the two halves, biasing the halves together. The common edge of the two halves is beveled to enable a key to cam the halves apart, permitting the insertion of the key in the keyhole. The cover can rotate in this opening upon insertion and turning of the key.

The padlock includes a shackle which is associated with the lock body for movement between an open position for engaging releasing objects to be secured and a closed position for locking the objects. Preferably, the shackle is situated in an offset arrangement in the lock body to facilitate attachment to objects that are close to walls and doors.

The shackle is secured in the locked position by operative elements such as by a primary, key-operable lock drivingly connected to a shackle by a drive linkage. The drive linkage can include meshed gear teeth on the shackle and on a gear that is rotatable with the key. Alternatively, the drive linkage includes a cam arm that engages a slot in the shackle. A secondary lock is spring biased into another notch in the shackle. A cam associated with the lock cylinder of the primary lock disengages the secondary lock as the key is turned, permitting the shackle to be directed to an open position.

In order to prevent failure of the lock under a force applied against either the shackle or the lock cylinder of the primary lock, the drive linkage is constructed to be weaker than the structure of the primary lock, causing the drive linkage to fail, preferably by shearing, before the primary lock. A secondary lock provides additional security in the event of the failure of the primary lock. Thus the integrity of the lock is preserved.

DETAILED DESCRIPTION OF THE PREFERRED EMBODIMENT

Figure 1:
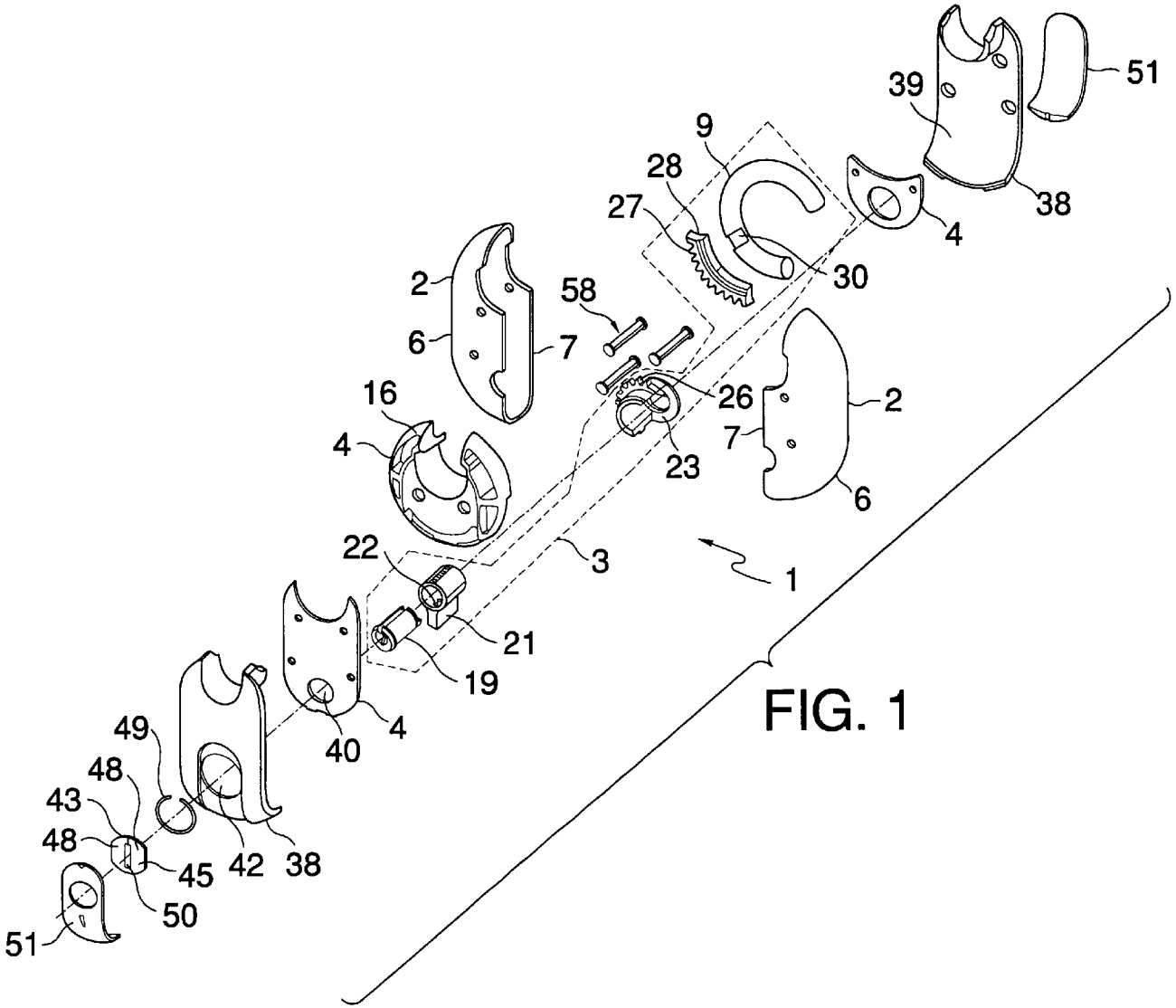
FIG. 1 is an exploded perspective view of one embodiment of the padlock of the present invention.
Figure 2:
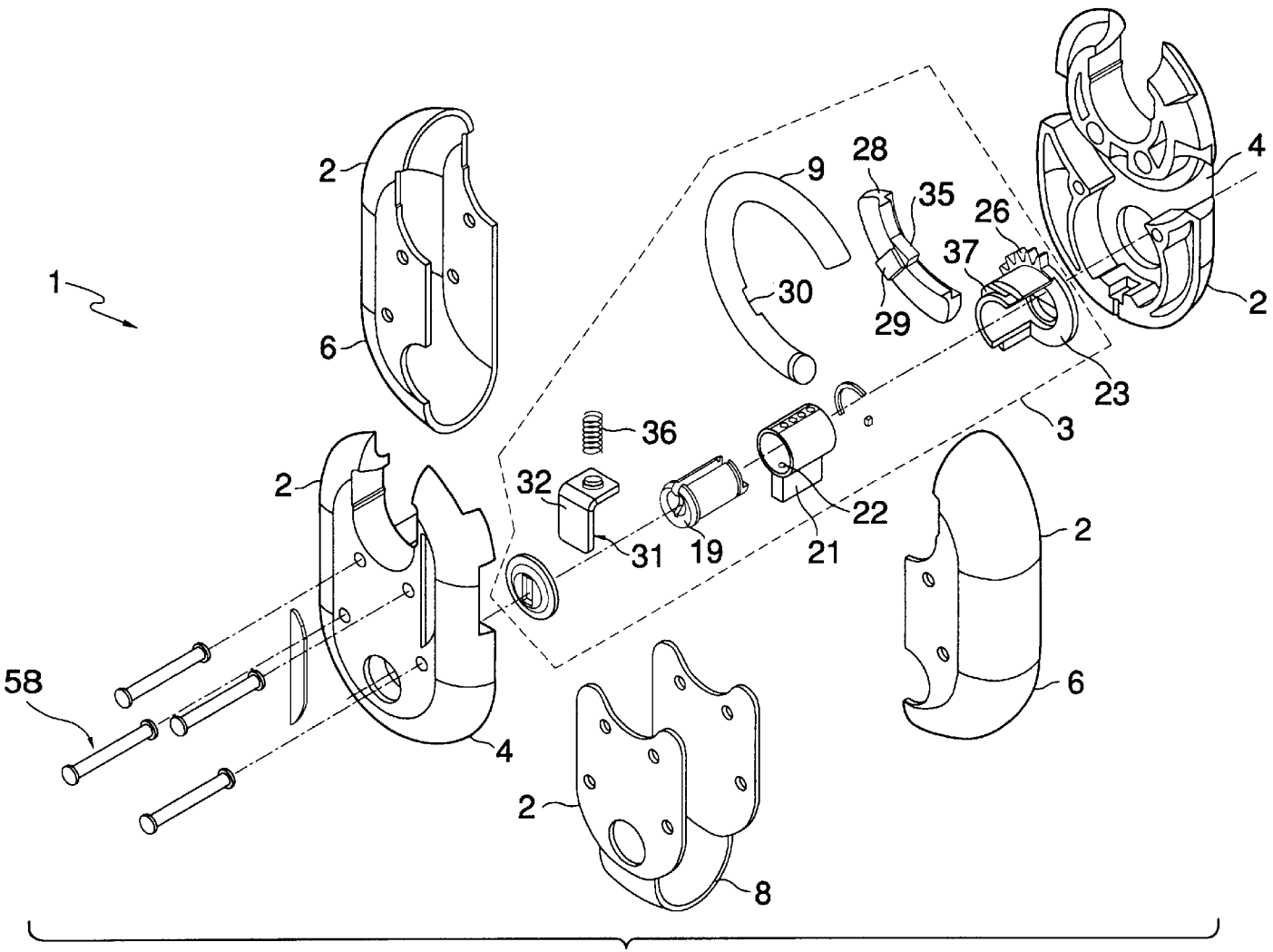
FIG. 2 is an exploded perspective view of a second embodiment of the padlock of the present invention.
Figure 3:
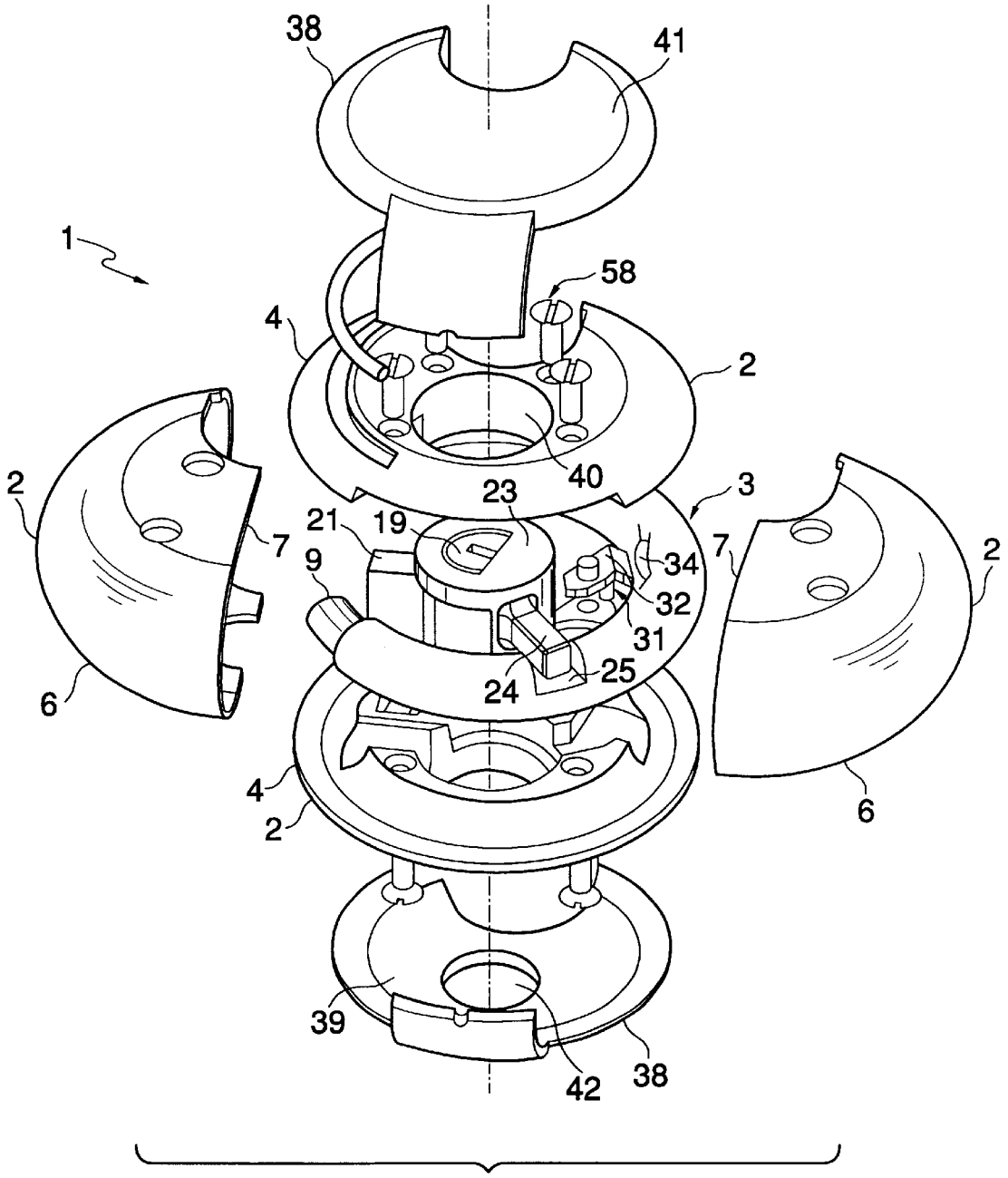
FIG. 3 is an exploded perspective view of a third embodiment of the padlock of the present invention.

Referring to FIGS. 1–3, the padlock 1 of the present invention includes a lock body 2. The material of the lock body 2 is made of a hard material that is selected to be rigid, strong, and resistant to tampering or attack by such means as sawing or prying. In addition, the lock body 2 has sufficient structural strength to resist such tampering and to support and house the lock mechanism or operative elements 3 of the padlock 1. Suitable materials for the lock body include stainless steel such as 304 stainless steel. The lock body 2 includes multiple shell layers that combine together to form the general overall shape of the padlock 1. The lock body 2 includes a first shell layer 4 made up of a plurality of first sub-shells. For example, the first shell layer 4 preferably includes three first sub-shells as shown in FIG. 1 or two first sub-shells as shown in FIGS. 2 and 3. The overall exterior shape of the padlock 1 is initially defined by the first shell layer 4 and includes either an oblong shape as shown in FIGS. 1 and 2 or circular shape as shown in FIG. 3.

Figure 5:
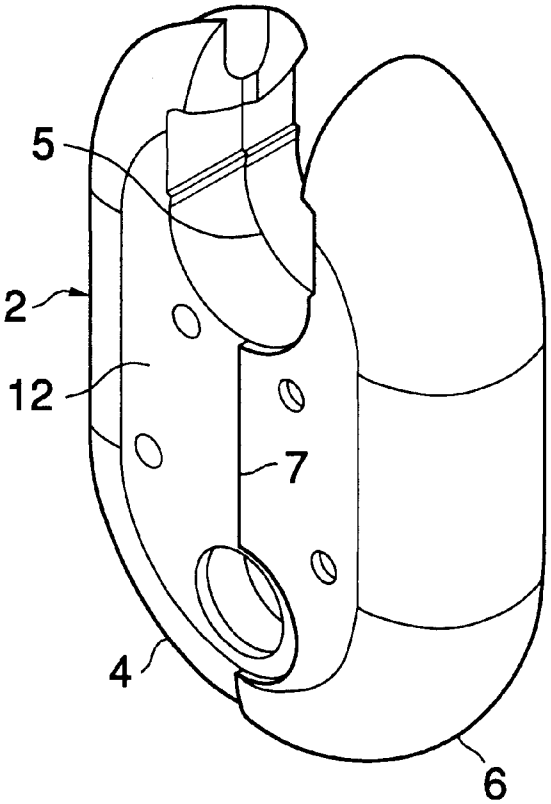
FIG. 5 is a perspective view of the first shell layer and half of the second shell layer of the padlock.
Figure 4:
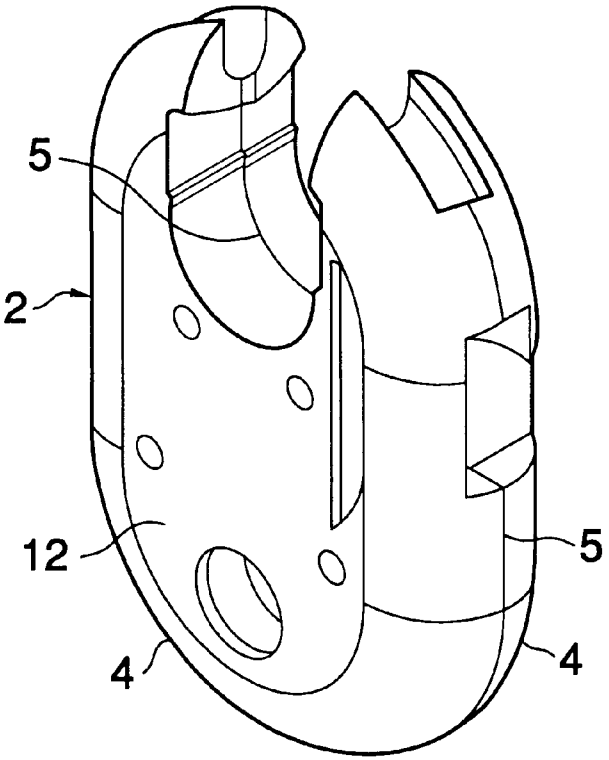
FIG. 4 is a perspective view of a first shell layer of the padlock.
Figure 6:
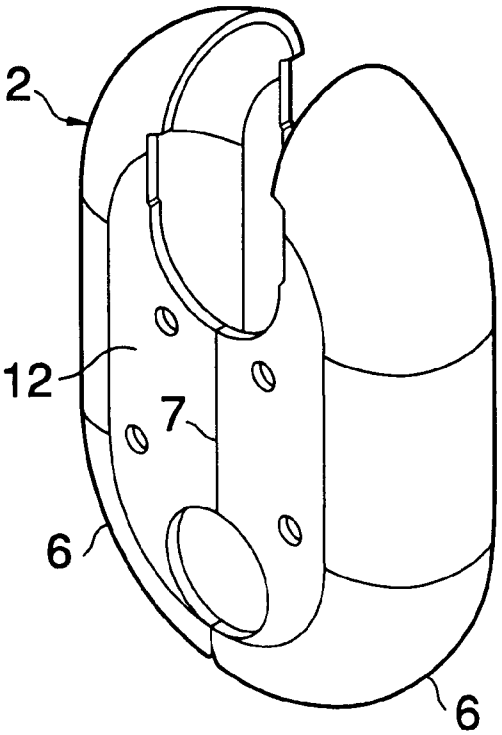
FIG. 6 is a perspective view of the second shell layer of the padlock.

As best shown in FIG. 4, when the sub-shells of the first shell layer 4 are joined together, they meet along and define a first interior seam 5. The first seam 5 would be a likely point of attacked for attempting to force the padlock 1 open by prying if the first seam 5 were exterior to the lock. In order to deter or prevent such an attack, the lock body 2 is provided with a second shell layer 6. As is best shown in FIG. 5, the second shell layer 6 is attached to the outside of the first shell layer 4. The second shell layer 6 itself may include a plurality of second sub-shells which join together to form the second shell layer 6. As shown in FIG. 6, the second shell layer 6 includes two sub-shells which join together over the outside of the first shell layer 4. The second shell layer should cover at least the first seams 5 of the first shell layer 4 in order to deter forced attack against the first seams 5, although preferably, the second shell layer 6 completely covers the outside of the first shell layer 4.

Since the second shell layer 6 itself includes a plurality of sub-shells, these sub-shells will meet along and define at least one second seam 7. Greater protection against prying open of the lock is provided because the second seam 7 is out of alignment with the first seam 5 as is depicted in FIG. 5. In other words, maximum protection is afforded to the first seam 5 when it does not correspond to the second seam 7. This can occur when the second seam 7 is not collinear with the first seam 5. Therefore, one attempting to pry the padlock open could not easily access the first seam 5 directly below the second seam 7. In the assembled lock body 2, if the second seam 7 was projected onto the first shell layer 4, it would intersect the first shell layer 4 at a line that is not collinear with the first seam 5. If the line did intersect the first seam 5, it would do so preferably only at points. At these points the intersection of the first seam 5 and the second seam 7 would form an angle between about 20° and about 90°. Thus, the first and second seams are not parallel. Since the second shell layer 6 is preferal by formed from two sub-shells joined together at a single second seam 7 which intersects the first seam 5 at two points, one along the top of the lock body 2 and the other along the bottom of the lock body 2, the angles defined therebetween are about 90°.

Figure 7:
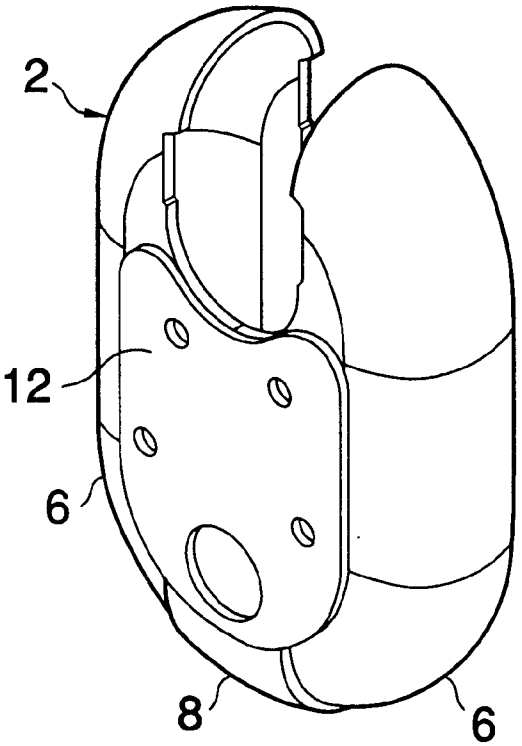
FIG. 7 is a perspective view of the second and third shell layers of the padlock.

As is best shown in FIGS. 2 and 7, further protection is preferably provided to the padlock 1 by a third shell layer 8. The third shell layer 8 is arranged to cover the second seam 7 while itself not defining any additional seams. The third shell layer 8 is formed of unitary construction as a single piece of material that is generally shaped as a saddle and is fitted over the second shell layer 6 covering the second seam 7 and is an extenor armor plate. The shell layers are held together by a plurality of fasteners 58 such as rivots, screws, or bolts.

Figure 9:
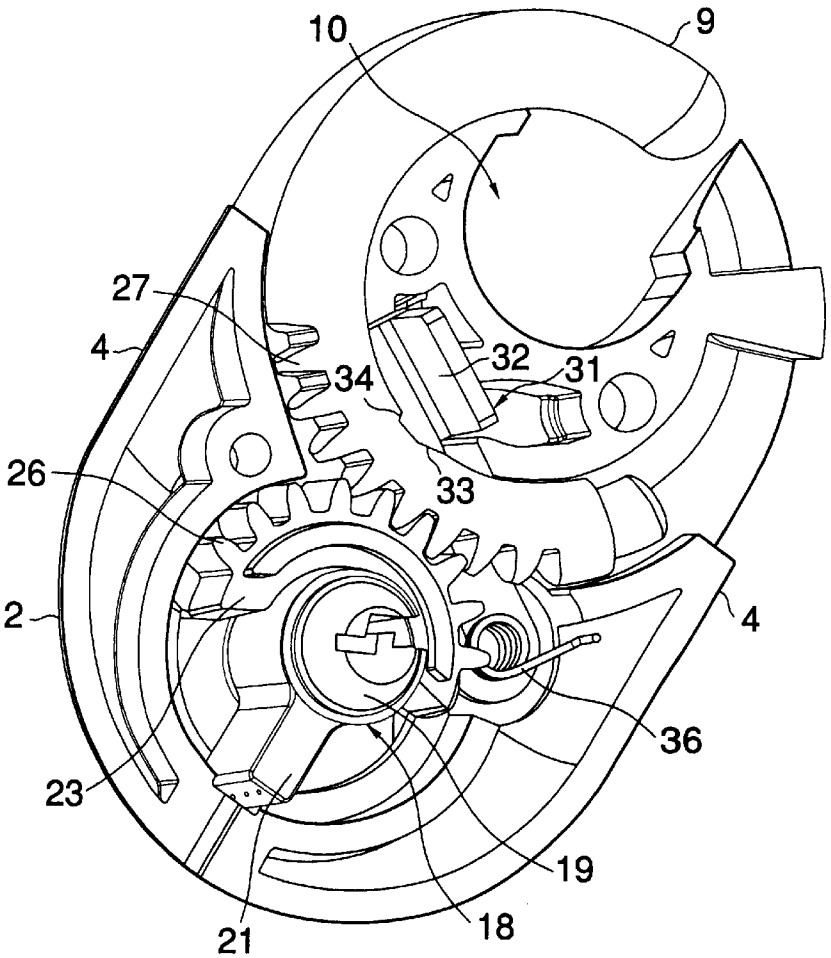
FIG. 9 is a perspective cutaway view of one embodiment of the padlock advancing toward a partially open position.
Figure 8:
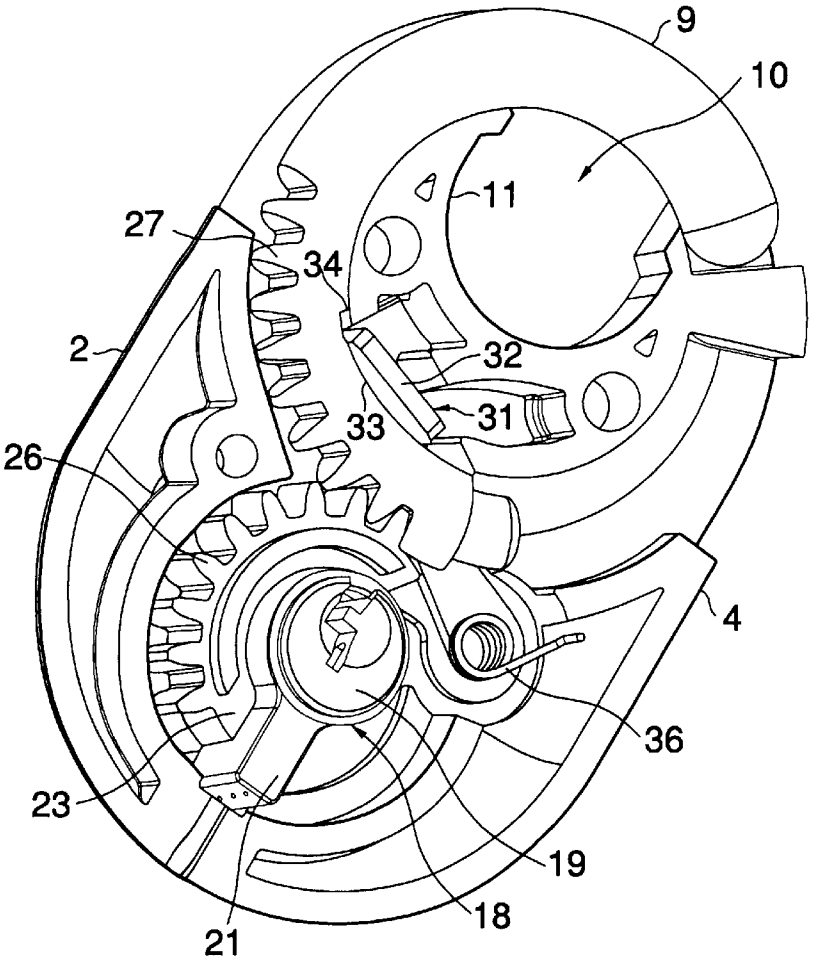
FIG. 8 is a perspective cutaway view of one embodiment of the padlock in the closed position.
Figure 11:
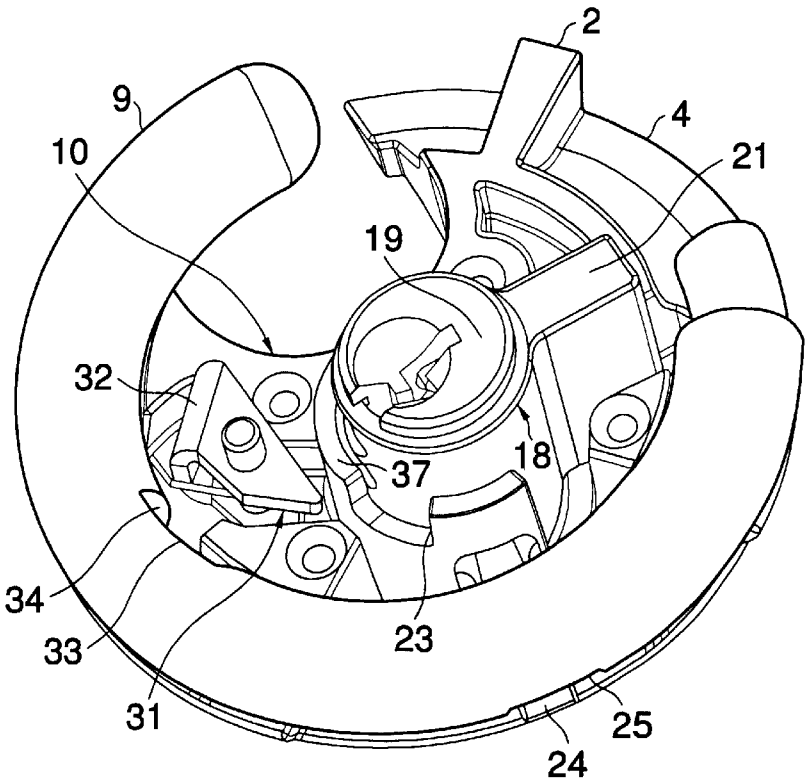
FIG. 11 is a perspective cutaway view of a second embodiment of the padlock advancing toward a partially open position.
Figure 10:
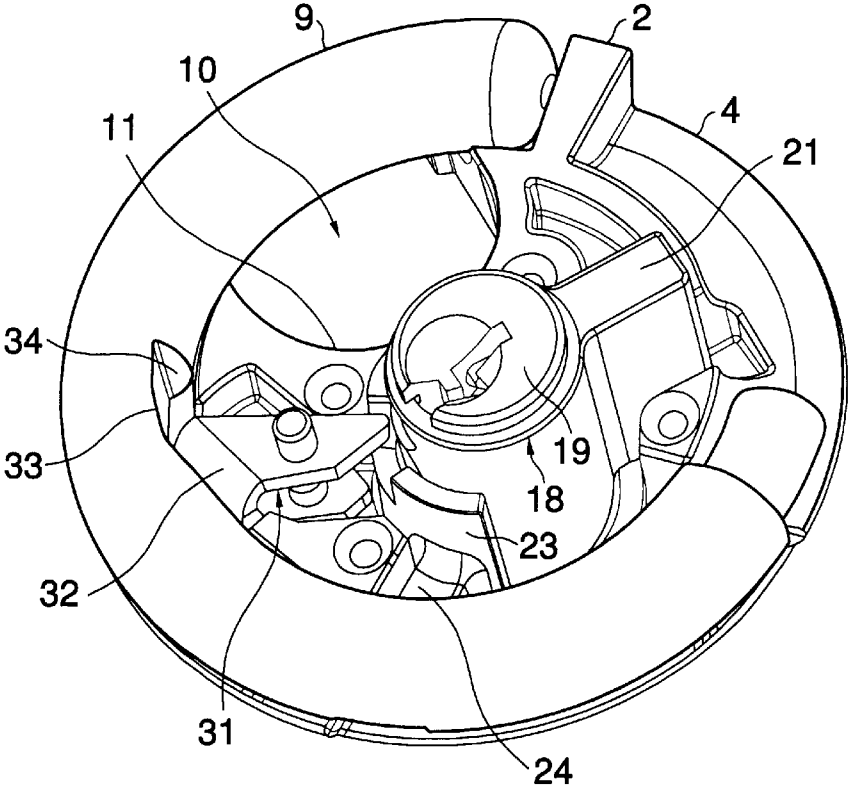
FIG. 10 is a perspective cutaway view of a second embodiment of the padlock in the closed position.

The padlock 1 includes a shackle 9 that is releasably lockable to the lock body 2 between a closed position corresponding to the locked state of the padlock 1 and an open position corresponding to the unlocked state of the padlock. Referring to FIGS. 8 and 10, in the closed position, the shackle 9 defines a space 10 between the shaekle 9 and the lock body 2 for securing objects to the padlock 1. Referring to FIGS. 9 and 11, in the open position, the shackle 9 is positioned for releasing and receiving objects between the shackle 9 and the lock body 2. Preferably, the shackle 9 is circular in shape and moves from the locked to the unlocked position through rotation within the lock body 2, defining the space by enclosing a recess 11 in the lock body 2. When an object such as a chain or a locker or door latch in contained within the recess 11 and the shackle 9 is in the closed position, the object is secured or locked by the padlock 1. In order to release the secured object, the shackle 9 is rotated to the open position. Suitable materials for the shackle include leaded, hardened steel.

Figure 12:
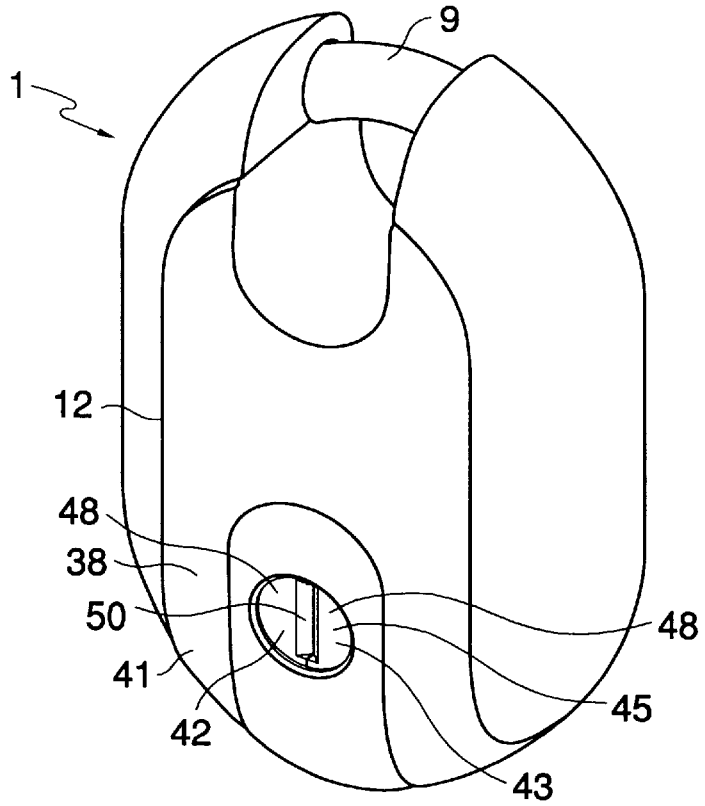
FIG. 12 is a perspective view of the padlock of the present invention having an offset shackle.
Figure 13:
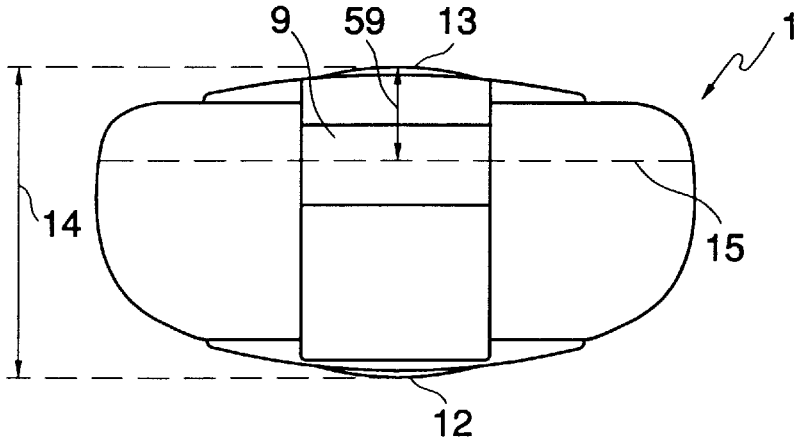
FIG. 13 is a top elevational view of the padlock of FIG. 12.
Figure 14:
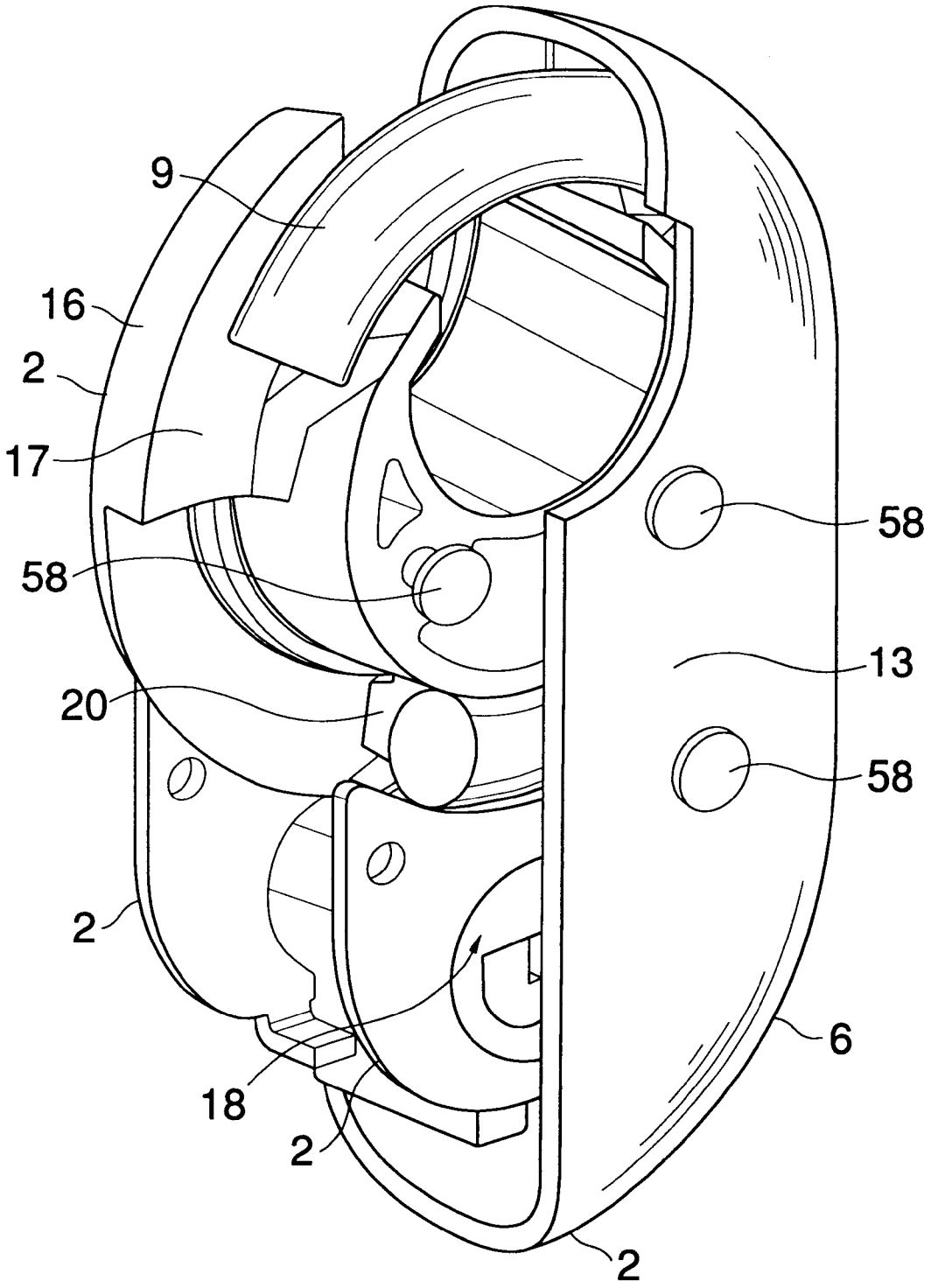
FIG. 14 is a cutaway perspective view of the padlock having an offset shackle.

The shackle 9 is at lest partially enclosed and supported by the lock body 2. As is best shown in FIGS. 12–14, the lock body includes a front surface 12 and a back surface 13 separated by a depth 14. The shackle is preferably disposed in the lock body 2 such that it is offset towards either the front surface 12, or forward most portion, or the back surface 13 as is best shown in FIG. 13. Preferably, the shackle 9 has a longitudinal axis 15 which when the shackle is in the closed position is positioned in the lock body 2 at a distance 59 measured from the back surface 13, or nearest portion, that is less than about 45% of the depth 14 and most preferably less than about 25% thereof. This offset facilitates attachment of the padlock to objects closely adjacent a wall or similar surface, such as door or locker latches, more easily accommodating the depth between the latch and the door or locker and hence laying flat against the door or locker.

As is best shown in FIGS. 2 and 14, the first shell layer 4 of the lock body 2 includes a spacer 16 for supporting the shackle 9 in a track 17 such that the shackle 9 is capable of rotational movement with respect to the lock body 2 between the open and the closed positions. The second shell layer 6 is spaced from the spacer 16, acting as a support shell to retain the shackle 9 in the track 17. The track positions the shackle closer to the back surface 13 than the front surface 12.

As shown in FIGS. 8–11, in the locked position, the shackle 9 is secured against movement out of the locked position by a primary lock 18 that is selectively lockable and unlockable. The primary lock 18 includes a drive linkage for operatively connecting to the shackle 9 and moving the shackle 9 between the closed and open positions. The drive linkage restricts the movement of the shackle 9 relative to the lock body 2 when the primary lock 18 is locked and drives the shackle 9 between the closed and the open position when the primary lock 18 is unlocked. The strength of the drive linkage is such that the drive linkage will fail before the primary lock 18 upon application of a predetermined force biasing the shackle 9 towards the open position from the closed position in an attempt to forceably pry the lock open. Since the drive linkage fails first before the primary lock 18, the primary lock 1 and the shackle still remains locked by a secondary lock.

Different types of primary locks and drive linkages can be used in the padlock 1, Generally, the padlock 1 includes a plug 19 for accepting a key 20 used to actuate the primary lock 18 and hence rotate the shackle 9. The primary lock 18 further includes a lock cylinder 21 and at least one tumbler 22 which is preferably a pin or wafer, that is releasably positionable and engageable between the plug 19 and the lock cylinder 21 when the primary lock 18 is in locked to prevent relative rotation between the plug 19 and the lock cylinder 21.

The drive linkage is suitable for holding the shackle 9 in the closed position and moving the shackle 9 from the closed to the open position. Generally, the driving linkage includes a cam 23 fixedly attached to the lock cylinder 21 and rotatable therewith.

As is best shown in FIGS. 3, 10, and 11, rotation of the plug 19 rotates the shackle 9 by an arm 24 extending from the cam 23 and engaging a slot 25 in the shackle 9.

In an alternative embodiment, as best shown in FIGS. 1, 2, 8, and 9, the cam 23 includes a plurality of cam gear teeth 26. The cam gear teeth 26 correspond with and are in cooperative engagement with a plurality of shackle gear teeth 27 that are preferably either integrally formed into the shackle 9 as shown in FIGS. 8 and 9 or as is best shown in FIGS. 1 and 2, are included in a gear rack 28. In order for the shackle 9 to rotate with the gear rack 28, the gear rack 28 includes a tang 29 cooperates with and engages a groove 30 in the shackle 9. As is best shown in FIG. 9, as the plug 19 is rotated, the cam 23 attached to the lock cylinder 21 also rotates causing the cam gear teeth 26 to traverse the shackle gear teeth 27 moving the shackle 9 from the locked to the unlocked position.

When the shackle 9 is in the closed position, a key 20 is required to advance the shackle to the open position. In the event that the lock is assaulted in an attempt to forceably rotate the lock cylinder 21 to the unlocked position, a force is applied simultaneously to the tumbler 22 in the lock cylinder 21 and the driving linkage in the primary lock 18, whether this is the cam arm 24 or the cam and shackle gear teeth. Should the tumblers 22 fail before the driving linkage by being sheared-off, then the lock cylinder 21 could be rotated with out the key. This would inactivate the primary lock 18 allowing the cam 23 to disengage the secondary lock 31 from the shackle and movement of the shackle to the open position. However, if the driving linkage fails first, then the lock cylinder 21 remains locked and still cannot be rotated without a key. For example, the drive linkage could have a first strength for resisting the applied force and the tumblers could have a second strength, the first strength being less than the second strength. Alternatively, the first strength could be some fraction of the second strength such as ½, ⅓, or ¼.

When the driving linkage fails, the primary lock 18 is disengaged from the shackle 9, but the secondary lock 31 prevents opening of the shackle past a secondary locked position even when the primary lock 18 fails. The secondary lock 31 preferably includes a lever 32 slideably or pivotally attached to the lock body 2. As best shown in FIGS. 8 and 10, in the locked position, the lever 32 engages a notch 33 in the shackle. The notch 33 includes a stop 34 that the lever 32 will contact in order to prevent rotation of the shackle 9. In the case where a gear rack 28 is used as the driving linkage, for example in FIG. 2, the lever 32 preferably engages a tab 35 extending from the gear rack 28. Suitable materials for the secondary lock 31 include stamped steel.

However, the lever 32 is preferably not in contact with the stop 34 when in the primary locked position. In fact, the shackle 9 may be rotated slightly toward the unlocked position before the lever 32 would contact the stop 34. Therefore, under a force applied to the lock cylinder 21 or the shackle 9 in an attempt to unlock the padlock 1 without the use of a key 20, the tumblers 22 and the driving linkage will carry the load and not the secondary lock 31, permitting the driving linkage to fail before the primary and seondary locks. Further, allowing the shackle 9 to rotate slightly permits the use of the cam 23 that is fixedly attached to the plug 19 to inactivate or disengage the secondary lock 31 under normal operation when a proper key is turned within the primary lock keyway. Since the lever 32 is biased into the notch 33 by a spring 16, the cam 23 includes a dog 37 that contacts the lever 32 and moves the lever 32 out of the notch 33 upon rotation of the lock cylinder 21 as can be seen in FIGS. 2, 9, and 11.

When the padlock is used or attached to an object to be secured the materials of the lock, preferably a registered and strong metal such as hardened steel, can lead to damage or marking of the objects to be secured and the shape of the lock can lead to discomfort in the hands of the user. Therefore, the padlock 1 is provided with a lock body 2 having rounded upper and lower contours. The shackle 9 also forms part of the upper contour, providing an ergonomic shape that is easily graspable by the user. Further, the padlock 1 can be combined with an exterior modular bumper 38. The modular protective bumper 38 is comprised of a cushioning material and has interior dimensions 39 that is form-fittingly shaped for accepting at least a portion of the lock body 2, including the keyway 40 that is defined by the lock cylinder 21 to accept the key 20 for the key operable lock. The bumper also includes exterior dimensions 41 of sufficient size to inhibit abrasive contact between the lock body 2 and the object to be secured and to contribute to the overall ergonomic shape and appearance. The bumper material is selected to provide comfort in the hand of the user and cushioning. Suitable materials include plastic materials, rubber materials, and mixtures thereof such as a high impact version ABS polycarbonate alloy.

Figure 15:
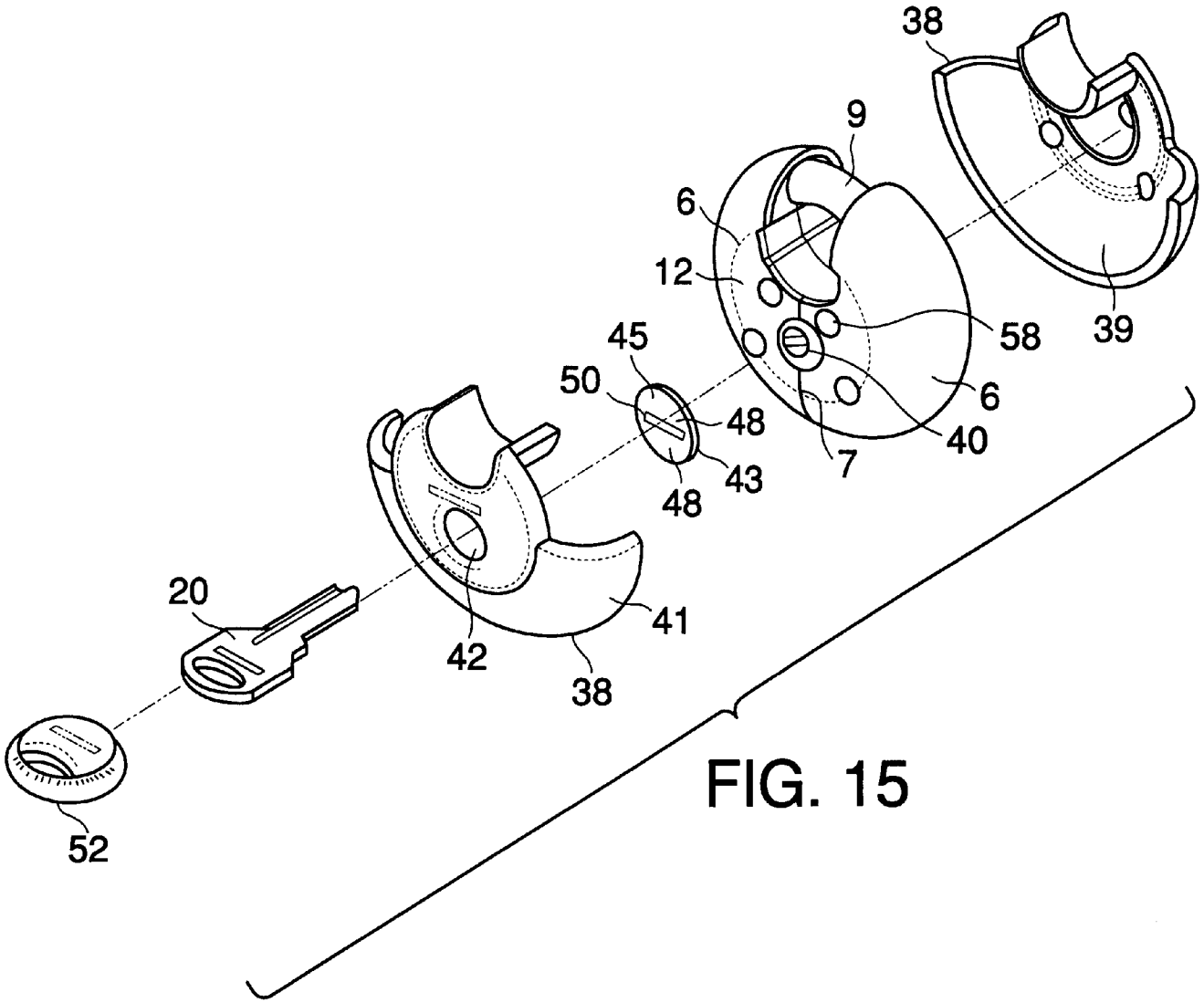
FIG. 15 is an exploded perspective view of one embodiment of the padlock with a key.
Figure 16:
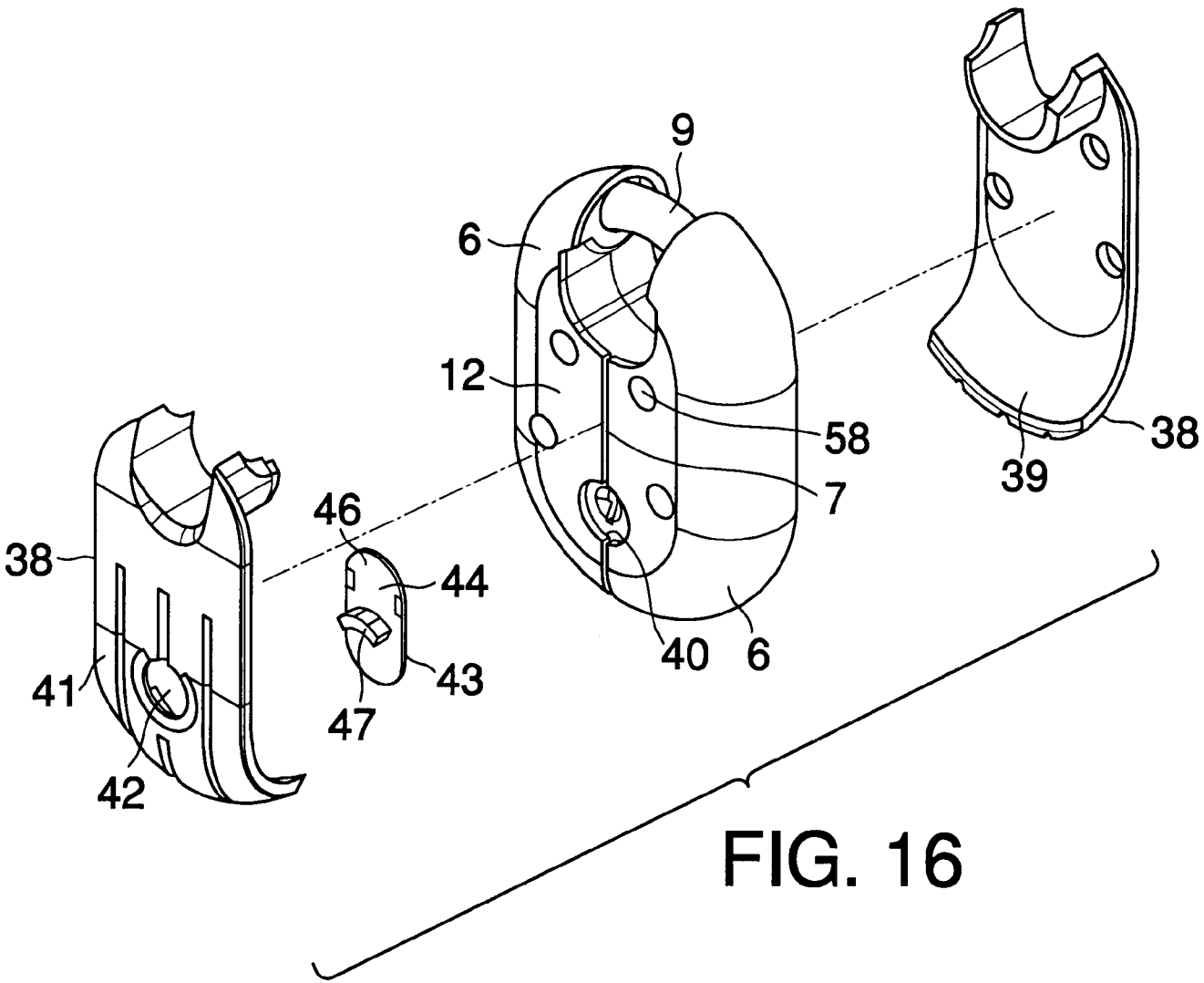
FIG. 16 is an exploded perspective view of a second embodiment of the padlock
Figure 17:
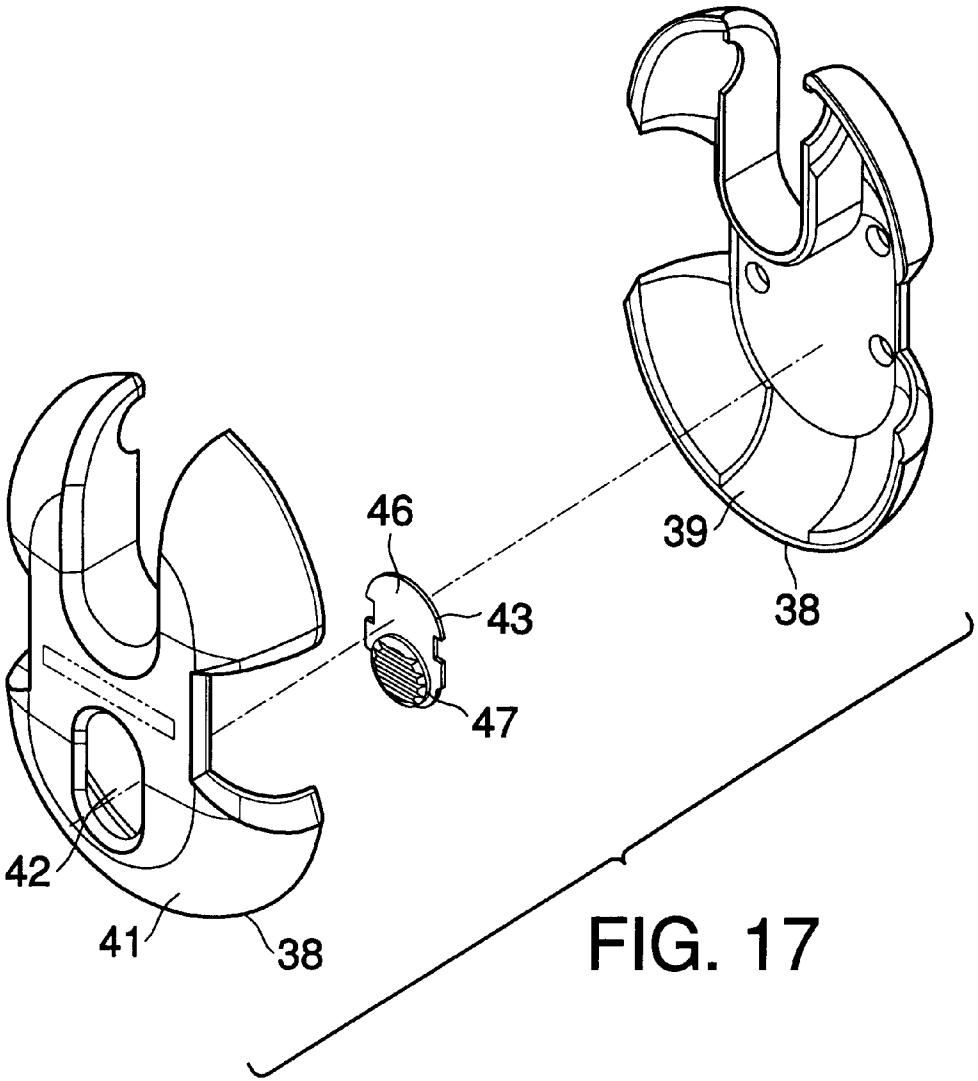
FIG. 17 is an exploded perspective view of one embodiment of the padlock bumper.
Figure 18:
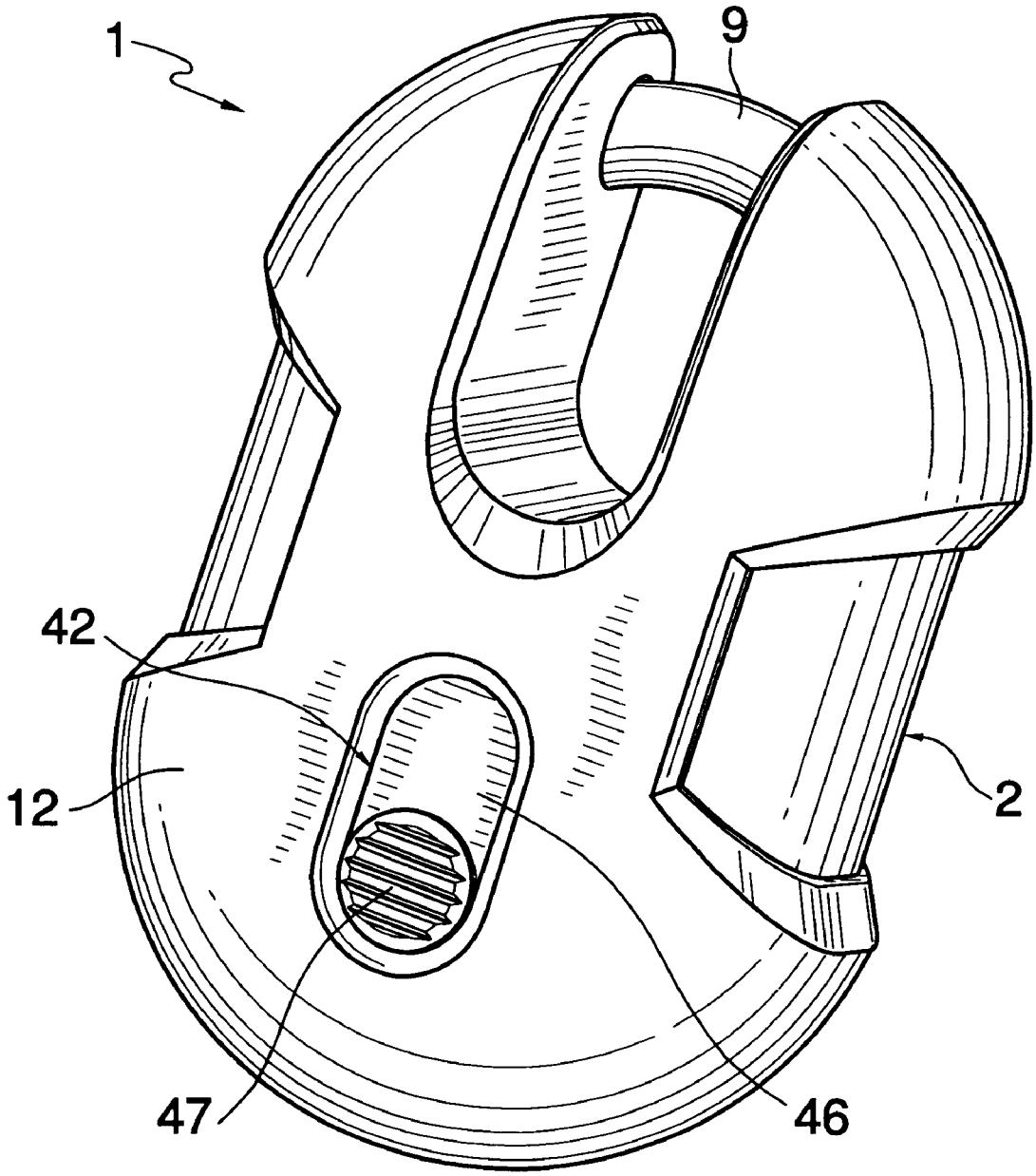
FIG. 18 is a perspective view of one embodiment of the padlock.
Figure 19:
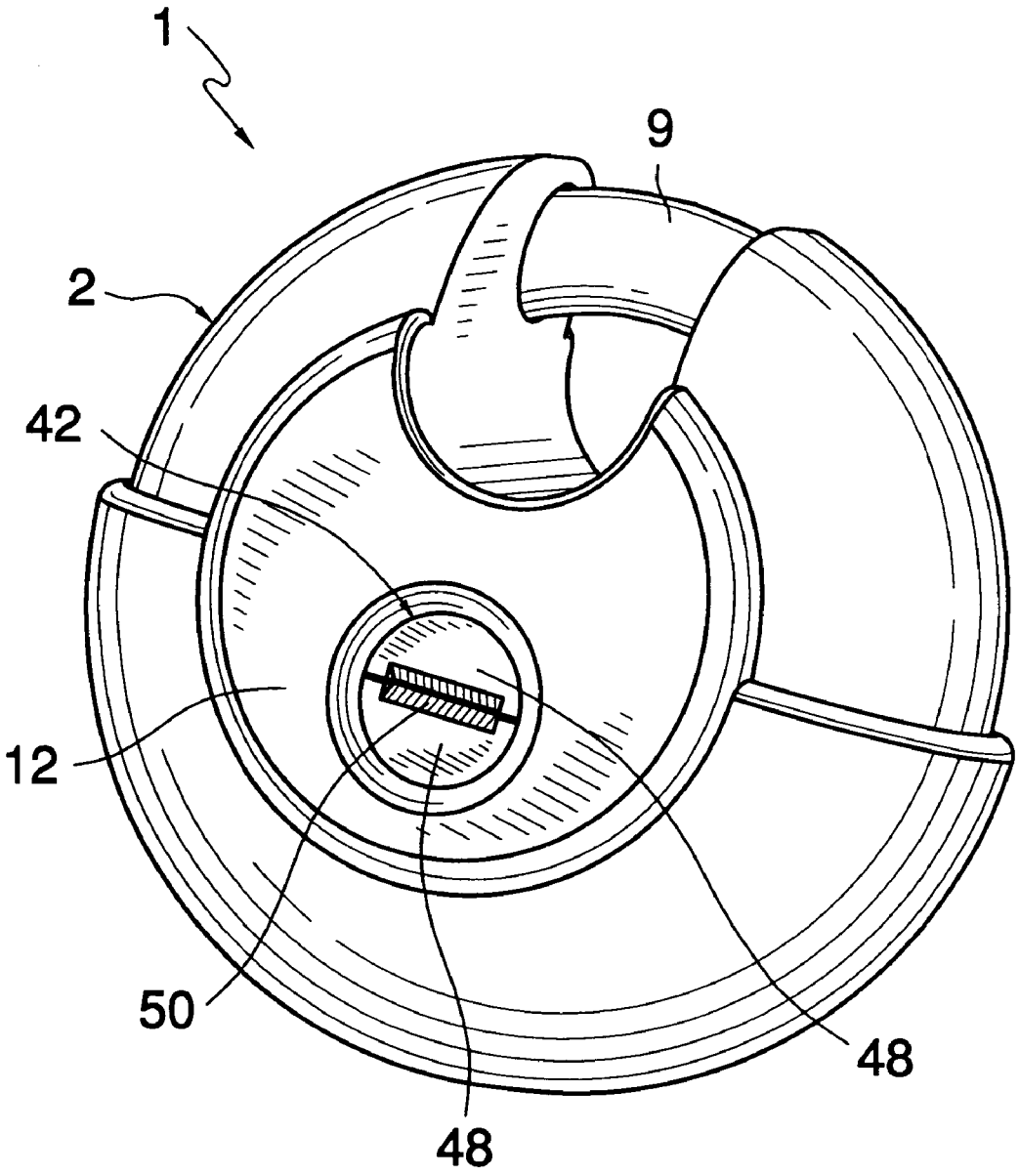
FIG. 19 is a perspective view of a second embodiment of the padlock.

Since the bumper 38 covers the keyway 40, a passage 42 through the bumper 38 to permit access to the lock cylinder 21 is provided. In order to prevent foreign debris and water from entering the lock cylinder 21 and adversely affecting the performance of the padlock 1, a keyway cover 43 is disposed in the passage 42 and is moveable between a first position covering the keyway 40 and a second position permitting access to the lock cylinder 19. The cover is preferably a sliding type cover 44 slideably engaged in the bumper 38 as shown in FIGS. 16 and 17 or a shutter-type cover 45 as shown in FIGS. 1, 13, and 15.

In the sliding type cover 44, the keyway cover 43 is slideably engaged in the bumper 38 between first and second positions. The sliding type cover includes a first portion 46 of sufficient size to cover the passage 42 substantially completely when the cover is in the first closed position and a raised portion 47 protruding up from the first portion 46 away from the keyway 40 for engaging a finger of a user to assist in sliding the cover.

In the shutter type cover, the shutter-type cover 45 is rotatable in the passage 42. Further, the shutter type cover can be comprised of a plurality of cover portions 48 and a spring clip 49 engaging the plurality of portions and biasing the portions into contact with one another to form the keyway cover 43. The cover portions 48 are capable of expanding away from each other to permit access to the lock cylinder 21 upon insertion of a key 20. Preferably the shutter-type cover 45 includes two semi-circular half portions having the spring clip 49 riding in a groove running along their circular edges the semi-circular half portions meeting along a central seam. In order to ease insertion of the key 20 into the lock cylinder 21, the cover portions 48 include a sloped surface 50 that is configured to be cammed towards the second open position by the force of the inserted key 20. A secondary bumper cover 51 may be included for rotatably holding the shutter-type cover 45 in the bumper 38.

Since the interior dimensions 39 of the bumpers 38 are arranged to accommodate the exterior of the padlock 1 and the exterior dimensions of the bumpers 38 can be varied to provide varying degrees of protection and various looks, a modular system is established wherein the look of the lock can be varied simply by changing the bumper 38 while maintaining the same lock body 2 and operative elements 3 of the padlock 1. This modularity can also be extended to a color coding system wherein the key 20 has a corresponding color coding to the bumper either by the key 20 itself being color coded or provided a color coded sheath 52 of for attachment to the key 20.

What is claimed is:

1. A padlock comprising:

(a) a lock body defining an interior cavity;

(b) a shackle releasably lockable to the body in a closed position defining a closed space between the shackle and the body for securing to an object, and movable to an open position for receiving and releasing the object between the shackle and the body;

(c) a primary lock disposed in the interior cavity and selectively lockable and unlockable;

wherein the lock body is made of a material of sufficient strength for shielding the interior cavity;

(d) a drive linkage associated with the primary lock and the shackle for restricting movement of the shackle relative to the lock body from the open position to the closed position when the primary lock is locked, and for driving the shackle between the open and closed position when the primary lock is unlocked; and (e) a secondary lock operatively engageable with the shackle in a locked position for restricting movement of the shackle from the closed towards the open position;

wherein the drive linkage has a first strength to resist a first predetermined force biasing the shackle form the closed position towards the open position mid the primary lock has a second strength, the first strength being less than the second strength such that the drive linkage fails upon application of a force greater than the predetermined force with the primary lock remaining intact.

2. The padlock of claim 1, wherein the primary lock comprises:

(a) a lock cylinder;

(b) a plug; and (c) at least one tumbler releasably positionable and engageable between the lock cylinder and the plug when the primary lock is locked for preventing relative rotation therebetween.

3. The padlock of claim 2, wherein the drive linkage comprises:

(a) a cam arm extending from the lock cylinder and engaging a slot in the shackle for moving the shackle from the closed to the open position upon rotation of the cylinder; and (b) the cam arm having the first strength and the tumbler having the second strength.

4. The padlock of claim 2, wherein the drive linkage comprises:

(a) a plurality of cam gear teeth associated with the lock cylinder and in cooperative engagement with a plurality of shackle gear teeth associated with the shackle for moving the shackle from the closed to the open position upon rotation of the lock cylinder; and (b) the cam and shackle gear teeth defining the first strength and the tumbler having the second strength.

5. The padlock of claim 2, wherein the secondary lock comprises:

(a) a cam rotatable by the cylinder;

(b) a lever moveably attached to the lock body and in engagement with a notch in the shackle when the shackle is in the closed position;

(c) a torsion spring associated with the lever for biasing the lever into the notch; and (d) a dog extending from the cam and disengaging the lever from the notch upon rotation of the lock cylinder toward the open position.

6. A padlock, comprising:

(a) a lock body;

(b) a shackle releasably lockable to the body in a closed position defining a closed space between the shackle and the body for securing to an object, and movable to an open position for receiving and releasing the object between the shackle and the body; and (c) a key-operable lock having a rotatable lock cylinder housed in the lock body and operatively connected to the shackle by a drive linkage, the drive linkage comprising:

(i) cam gear teeth rotatable with the lock cylinder;

(ii) a gear rack independent of and extending along at least a portion of the shackle, operatively engaged with the cam gear teeth and releasably attachable to the shackle for rotation therewith;

wherein upon rotation of the lock cylinder, the cam gear teeth move the gear rack which moves the shackle from the closed to the open position.

* * * * *